US007753362B2

(12) United States Patent
Hanabusa

(10) Patent No.: US 7,753,362 B2
(45) Date of Patent: Jul. 13, 2010

(54) SHEET FEEDING APPARATUS AND RECORDING APPARATUS

(75) Inventor: Tadashi Hanabusa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 557 days.

(21) Appl. No.: 10/928,281

(22) Filed: Aug. 30, 2004

(65) Prior Publication Data

US 2005/0062214 A1 Mar. 24, 2005

(30) Foreign Application Priority Data

Aug. 29, 2003 (JP) ..... 2003-306414

(51) Int. Cl.
*B65H 3/06* (2006.01)

(52) U.S. Cl. ..... 271/118; 271/114; 271/126

(58) Field of Classification Search ..... 271/109, 271/114, 126, 127, 162, 213, 117, 118; 347/108; 400/624

See application file for complete search history.

(56) References Cited

U.S. PATENT DOCUMENTS 4,475,731 A * 10/1984 Wood ..... 271/9.05
5,244,191 A * 9/1993 Kanekura ..... 271/10.11
6,793,425 B2 9/2004 Yoshikawa et al. ..... 400/624
2002/0167124 A1 11/2002 Hanabusa ..... 271/125
2002/0171193 A1 11/2002 Asai et al. ..... 271/121
2002/0175462 A1 11/2002 Sonoda et al. ..... 271/121
2002/1017546 * 11/2002 Sonoda et al. ..... 271/121
2004/1004133 * 3/2004 Sonoda et al. ..... 271/121

FOREIGN PATENT DOCUMENTS

JP 2003-26349 1/2003

* cited by examiner

*Primary Examiner*—Patrick H Mackey
*Assistant Examiner*—Michael C McCullough
(74) *Attorney, Agent, or Firm*—Fitzpatrick, Cella, Harper & Scinto

(57) ABSTRACT

Disclosed is a sheet feeding apparatus capable of easily changing an amount of conveyance of sheet materials without increasing the costs. A sheet feeding roller body is constructed of a cylindrical sheet feeding roller support member provided with a sheet feeding roller and a gear on both sides thereof. A support portion of a sheet feeding shaft is inserted with a gap through a through-hole of the sheet feeding roller body, whereby the sheet feeding roller is rotatably supported by the sheet feeding shaft. The sheet feeding shaft receives a driving force via a sheet feeding shaft gear and thus rotates. The sheet feeding roller of the sheet feeding roller body receives a driving force via the gear from an ASF control gear and thus rotates, whereby the sheet feeding shaft and the sheet feeding roller can be rotated with different numbers of rotations.

6 Claims, 9 Drawing Sheets

SHEET FEEDING APPARATUS AND RECORDING APPARATUS

BACKGROUND OF THE INVENTION

1. Field of the Invention

The present invention relates generally to the sheet feeding apparatus which picks up a plurality of stacked sheet materials sheet by sheet and conveys a sheet material, more particularly to a sheet feeding apparatus including a pressure plate that brings the stacked sheet material into press-contact with a sheet feeding roller, and also to a recording apparatus including the sheet feeding apparatus, such as a printer, a copying machine, a printing apparatus, a facsimile, a scanner and so on.

2. Related Background Art

A typical system of a conventional sheet feeding apparatus including a pressure plate that brings a stacked sheet material into press-contact with a sheet feeding roller, is that the sheet feeding roller makes one rotation for, as in the invention disclosed in, e.g., Japanese Patent Application Laid-Open No. 2003-026349, a press-contacting/separating operation of the pressure plate with respect to the sheet feeding roller, a press-contacting/separating operation of a separation roller with respect to the sheet feeding roller via a torque limiter and a return lever operation of returning a leading end of the sheet material to a predetermined position. Namely, according to this system, the sheet feeding roller performs one rotation for one cyclic operations of respective members for feeding only one sheet material from a sheet stacking portion to a sheet lead-in roller provided on the side of a main body, which serves as an exit of an ASF (Auto Sheet Feeder). In a printer equipped with the thus-constructed sheet feeding apparatus, a main body unit of the printer is fed with the sheet material corresponding to a circumferential length of the sheet feeding roller from the sheet feeding apparatus.

In the prior art described above, however, if a necessary conveying length from the sheet stacking portion to the ASF exit elongates due to a structure of the main body unit attached with the ASF, it is required that the circumferential length of the sheet feeding roller be increased in order to complete the conveyance of the sheet material during one cyclic operations of the respective members. Namely, when the conveying length elongates, there is a necessity of increasing a diameter of the sheet feeding roller, thereby inducing rises both in size of the apparatus and in costs.

On the other hand, in the case of reducing the conveying length, the sheet feeding roller having a diameter corresponding to the conveying length must be prepared, and what is demanded is a construction capable of easily changing specifications without increasing the costs.

SUMMARY OF THE INVENTION

It is a primary object of the present invention to provide a sheet feeding apparatus that can be diverted to other main body unit having a different conveying length without raising costs, and also a recording apparatus.

It is another object of the present invention to provide a sheet feeding apparatus for feeding a sheet material by separating the plurality of stacked sheet materials sheet by sheet, the apparatus including a plurality of control members for feeding only one sheet material through one cyclic operations of the control members, wherein a sheet feeding roller is rotatably held coaxially with a sheet feeding shaft making one rotation with one cyclic operations of the control members and rotates with a number of rotations different from a number of rotations of the sheet feeding shaft.

It is a further object of the present invention to provide a sheet feeding apparatus for feeding a sheet material by separating the plurality of stacked sheet materials sheet by sheet, the apparatus including a sheet feeding roller for feeding the sheet material in such a way that the sheet feeding roller is brought into press-contact with the surface of the sheet material, and a rotary shaft disposed coaxially with the sheet feeding roller, wherein the rotary shaft is provided with a plurality of cams in opposite positions with the sheet feeding roller interposed therebetween, and the sheet feeding roller and the rotary shaft rotate at relatively different speeds.

DESCRIPTION OF THE PREFERRED EMBODIMENTS

Embodiments of the present invention will next be described with reference to the drawings.

Figure 1:
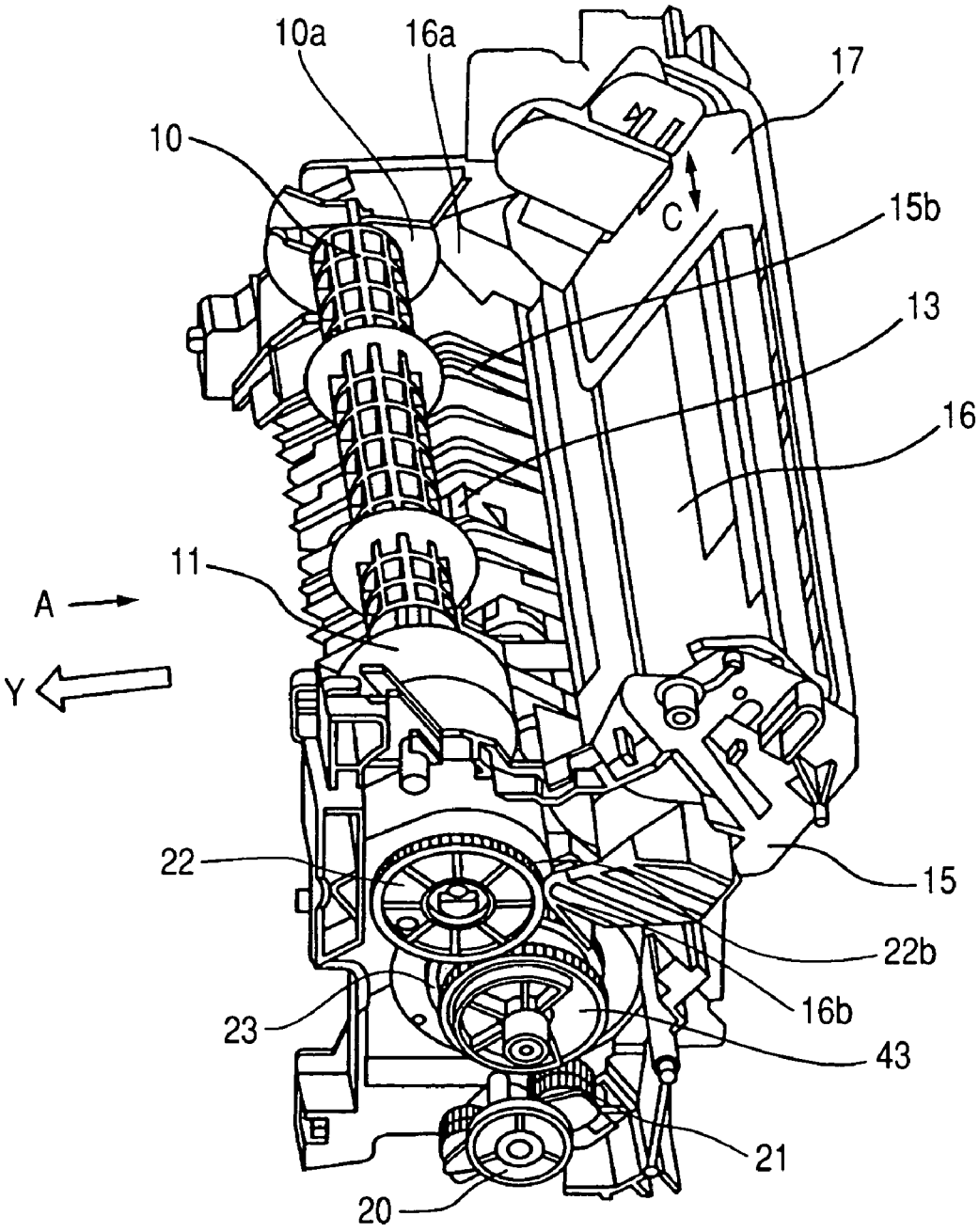
FIG. 1 is a schematic perspective view showing a whole of sheet feeding apparatus according to one embodiment of the present invention.
Figure 2:
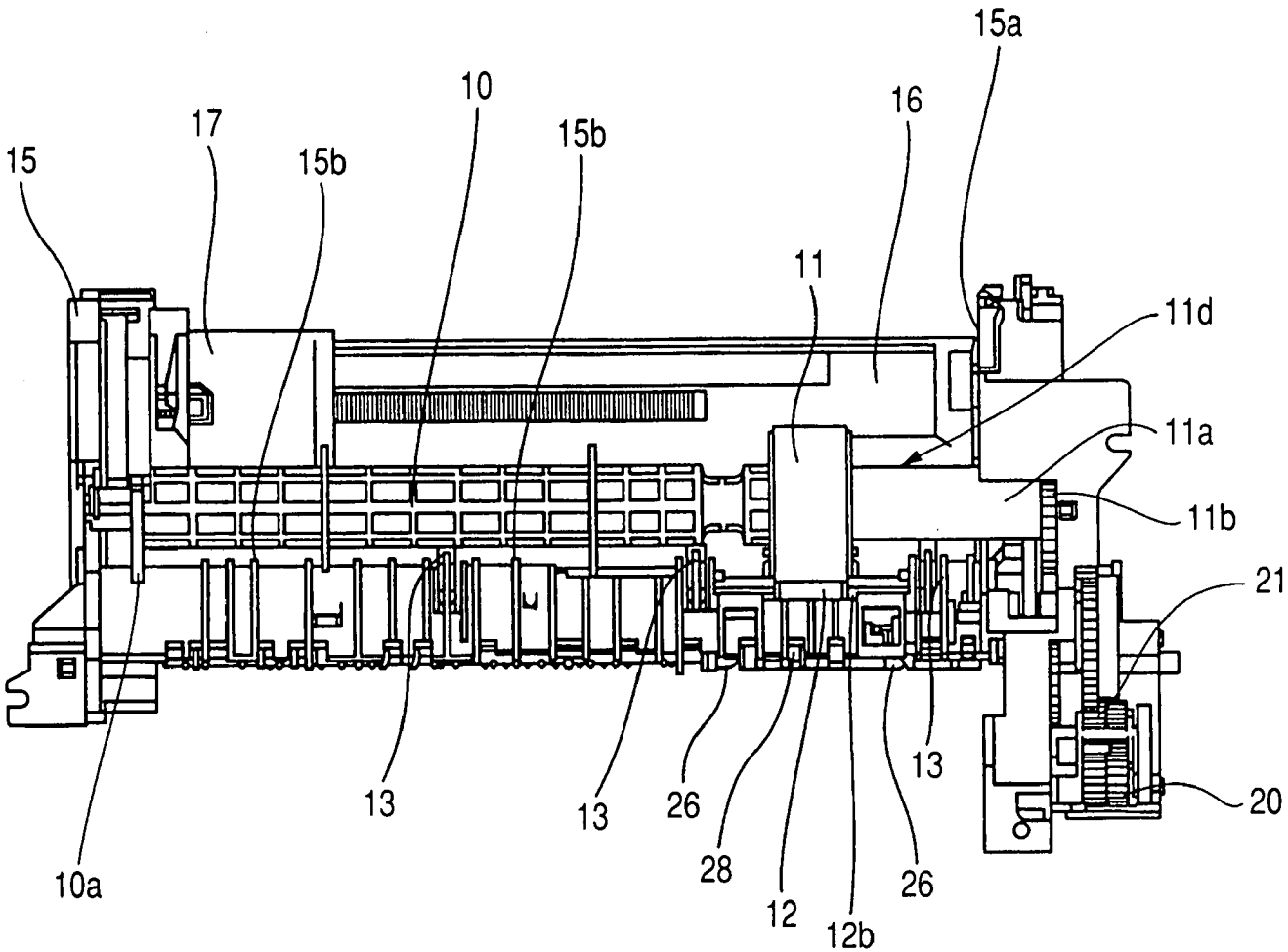
FIG. 2 is a schematic front view showing the whole of sheet feeding apparatus according to one embodiment of the present invention.
Figure 3:
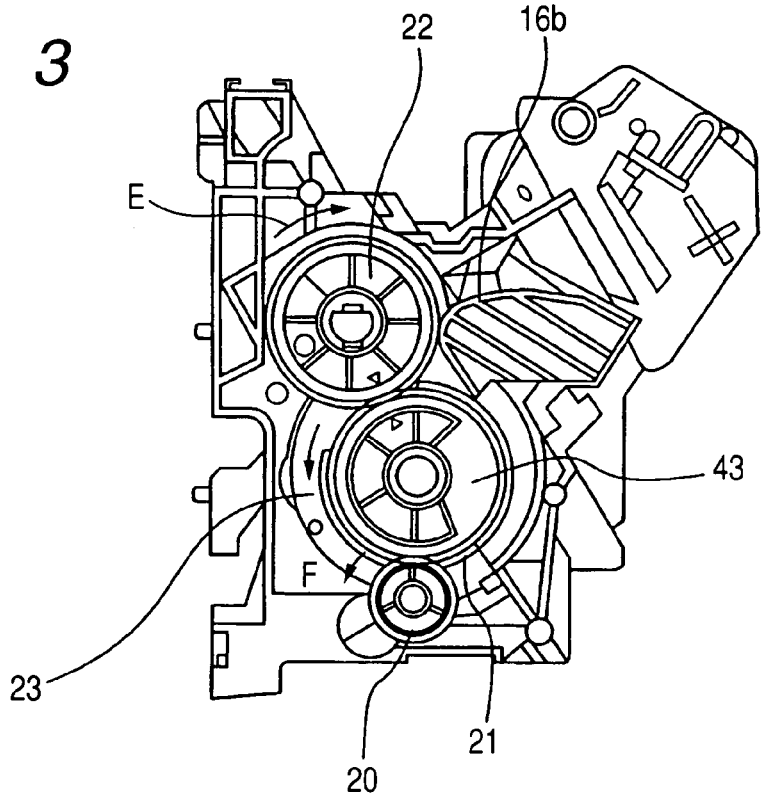
FIG. 3 is a schematic side view showing the whole of sheet feeding apparatus according to one embodiment of the present invention.

FIG. 1 is a schematic perspective view of a sheet feeding apparatus in the present embodiment. FIG. 2 is a schematic front view of the sheet feeding apparatus in the present embodiment as viewed in a direction A' shown in FIG. 1. FIG. 3 is a schematic side view of the sheet feeding apparatus in the present embodiment as viewed in a direction X shown in FIG.

Figure 4:
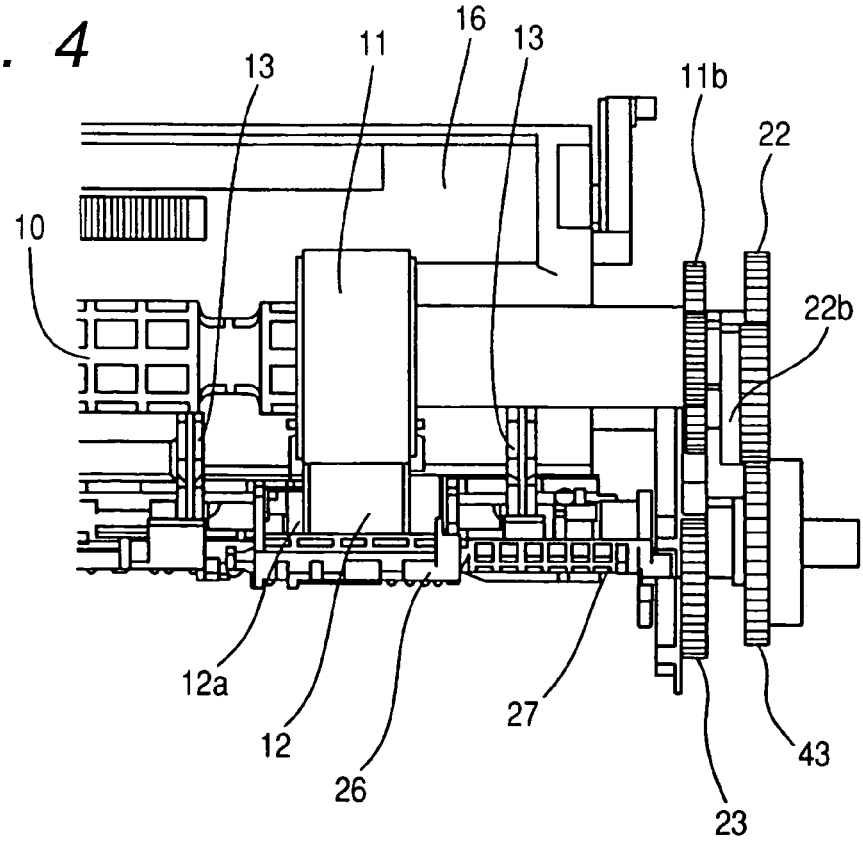
FIG. 4 is an enlarged schematic front view of the sheet feeding apparatus with some portions simplified according to one embodiment of the present invention.

1. FIG. 4 is an enlarged schematic front view, with some portions simplified, of the sheet feeding apparatus in the present embodiment.

In FIGS. 1, 2, 3 and 4, the sheet feeding apparatus (which may also be referred to as an auto sheet feeder (ASF)) includes a sheet feeding roller 11, a sheet feeding shaft (rotary shaft) 10, a separation roller 12, a return lever 13, an ASF base 15, a pressure plate 16 and a side guide 17. The sheet feeding roller 11, attached to a sheet feeding roller support member 11*a*, is defined as one piece of rotary sheet feeding member for feeding a sheet material in a way that press-fits to the surface of the sheet material (e.g., sheet paper) such as a recording material, a copying material, an original and so on. The sheet feeding roller 10 rotatably supports the sheet feeding roller support member 11*a*. The separation roller 12 serves to separate the sheet material and is provided in a way that faces the sheet feeding roller 11 in a position where the sheet material is pinched. The return lever 13 serves to prevent double-feeding of the sheet material and is provided in such a position as to abut on the backface of the sheet material with respect to the sheet feeding roller 11. The ASF base 15 serves as a frame of the sheet feeding apparatus. The pressure plate 16, on which the sheet material is placed, presses the sheet material against the sheet feeding roller 11. The side guide 17, which is disposed orthogonal to a conveying direction Y of the sheet material, performs positioning of a side portion of the sheet material.

Figure 5:
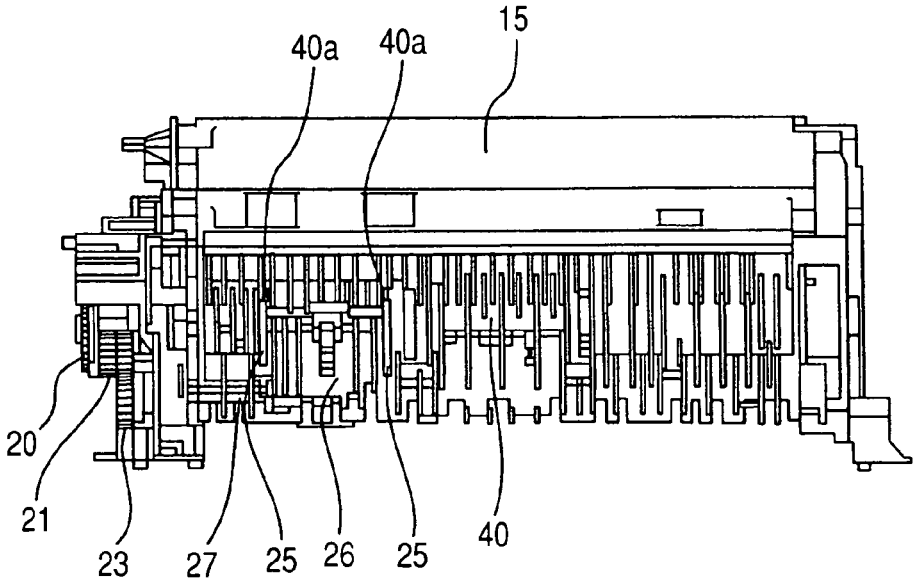
FIG. 5 is a schematic bottom view showing the whole of sheet feeding apparatus according to one embodiment of the present invention.

FIG. 5 is a schematic bottom view of the sheet feeding apparatus in the present embodiment as viewed in a direction D shown in FIG. 2.

In FIG. 5, the sheet feeding apparatus in the present embodiment has an ASF bottom cover 40 covering the whole undersurface of the ASF.

To begin with, the sheet feeding apparatus is designed on the premise that this sheet feeding apparatus is to be used integrally with other apparatuses such a recording apparatus, an image forming apparatus, an image reading apparatus, etc., like a printer, a copying machine, a printing machine, a facsimile, a scanner and so on. For example, a preferable type of recording apparatus, which is equipped with the sheet feeding apparatus of the present invention and thus records pieces of record information on a record sheet, preferably includes an inkjet recording means for performing the record by discharging droplets of liquid inks onto the sheet material via nozzles.

Next, the sheet feeding apparatus in the present embodiment is constructed roughly of a sheet material stacking portion, a feeding/separating portion, a double-feeding preventive portion and a media discriminating portion.

(Sheet Material Stacking Portion)

A sheet material conveying fiducial portion 15*a* is provided protruding from part of the ASF base 15 serves as a fiducial portion for positioning the side part of the sheet material in the direction orthogonal to the sheet material conveying direction, and the sheet material stacking portion is constructed of the pressure plate 16 and the side guide 17 for regulating the sheet material side part opposite to the sheet material conveying fiducial portion 15*a*. When the operation of the sheet feeding apparatus is in a non-conveying state, i.e., in a so-called standby state, the pressure plate 16 is fixed in a predetermined position in such a direction as to get apart from the sheet feed roller 11. On this occasion, a gap large enough to stack up a plurality of sheet materials is ensured between the sheet feeding roller 11 and the pressure plate 16.

The sheet feeding apparatus is designed to accommodate (in adaptation to) the sheet materials having arbitrary sizes coming into a predetermined widthwise range, and hence, after the plurality of sheet materials have been stacked in the aforementioned gap along the sheet material conveying fiducial portion 15*a*, the side guide 17 is moved in an arrowhead direction C in FIG. 1 and adjusted to the width of the sheet material. The stack of sheet materials set in the sheet material stacking portion is regulated in their movement in a direction orthogonal to the sheet material conveying direction, thereby enabling the sheet materials to be stably conveyed. The side guide 17 is, though slidably fitted to the pressure plate 16, engaged with a latch groove cut in the pressure plate 16 and thus can be fixed thereto so as not to move carelessly. Therefore, when moving the side guide 17, the side guide 17 is disengaged from the latch groove by operating a lever portion provided on the side guide 17 and is thus moved.

The sheet materials to be stacked up descend downward by dint of the gravity, however, a leading end thereof abuts on the sheet material leading-end fiducial portion 15*b* fixedly provided on the ASF base 15. Note that the sheet material leading-end fiducial portion 15*b* takes a rib-like configuration in order to reduce a load applied when feeding the sheet material in the present embodiment.

The pressure plate 16 has a center of rotation (a rotary spindle) at its upper end and is thereby rotationally movable. An operation of the pressure plate 16 is controlled by a spring and a cam, whereby the pressure plate 16 is rotationally biased by an unillustrated pressure plate spring in a direction of the sheet feeding roller 11 and is forcibly rotationally moved in such a direction as to get apart from the aforementioned sheet feeding roller 11 when cams 16*a* and 16*b* of the pressure plate 16 are pressed by a pressure plate cam 10*a* provided on a sheet feeding shaft 10 and a pressure plate cam 22*b* provided on a sheet feeding shaft gear 22, which will be explained later on. It should be noted that the pressure plate spring is so constructed as to press the backside of the pressure plate 16 toward the opposite side of the sheet feeding roller 11 with the pressure plate 16 being interposed therebetween. There is no problem if constructed so that both sides of the pressure plate 16 are supported by the pressure plate cam 10*a* and the pressure plate cam 22*b* as in the present embodiment. For instance, however, in a construction that the pressure plate 16 is supported by only the pressure plate cam 22*b* without the pressure plate cam 10*a*, the pressure plate might undesirably warp in a leave-to-stand state at a comparatively high temperature (e.g., 60° C.) over a long period of time when in distribution and in the leave-to-stand state over the long period of time when normally used.

The sheet material is fed by conducting the biasing/separating operations described above at a predetermined timing.

(Sheet Feeding/Separating Portion)

The pressure plate 16 described above operates at the predetermined timing, and the stack of sheet materials stacked in the sheet material stacking portion is pressed by the sheet feeding roller 11. The stack of sheet materials is pressed and simultaneously brought into contact with the sheet feeding roller 11 as the sheet feeding roller 11 is rotationally driven. The uppermost sheet material in the stack of sheet materials is conveyed by a frictional force of the sheet feeding roller 11. The sheet feeding roller 11 thus conveys the sheet material with its frictional force and is therefore, it is preferable, composed of a material such as a rubber, elastomer, etc., having a higher frictional coefficient than a frictional coefficient of the sheet material as exemplified by EPDM (ethylene-propylene-diene-mixed-polymer) of which hardness is on the order or 20° to 40° (A-scale).

Next, a drive mechanism of the sheet feeding/separating portion will be described with reference to FIGS. 1 to 7.

Figure 6:
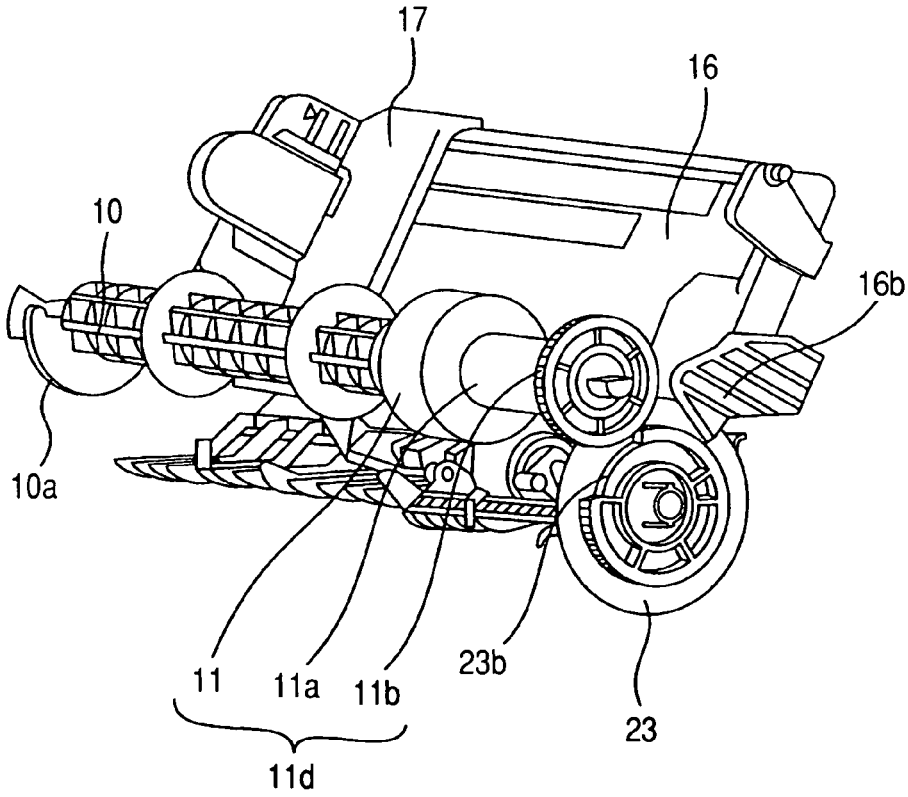
FIG. 6 is a partial perspective view illustrating a gear portion of an ASF control gear of the sheet feeding apparatus according to one embodiment of the present invention.
Figure 7:
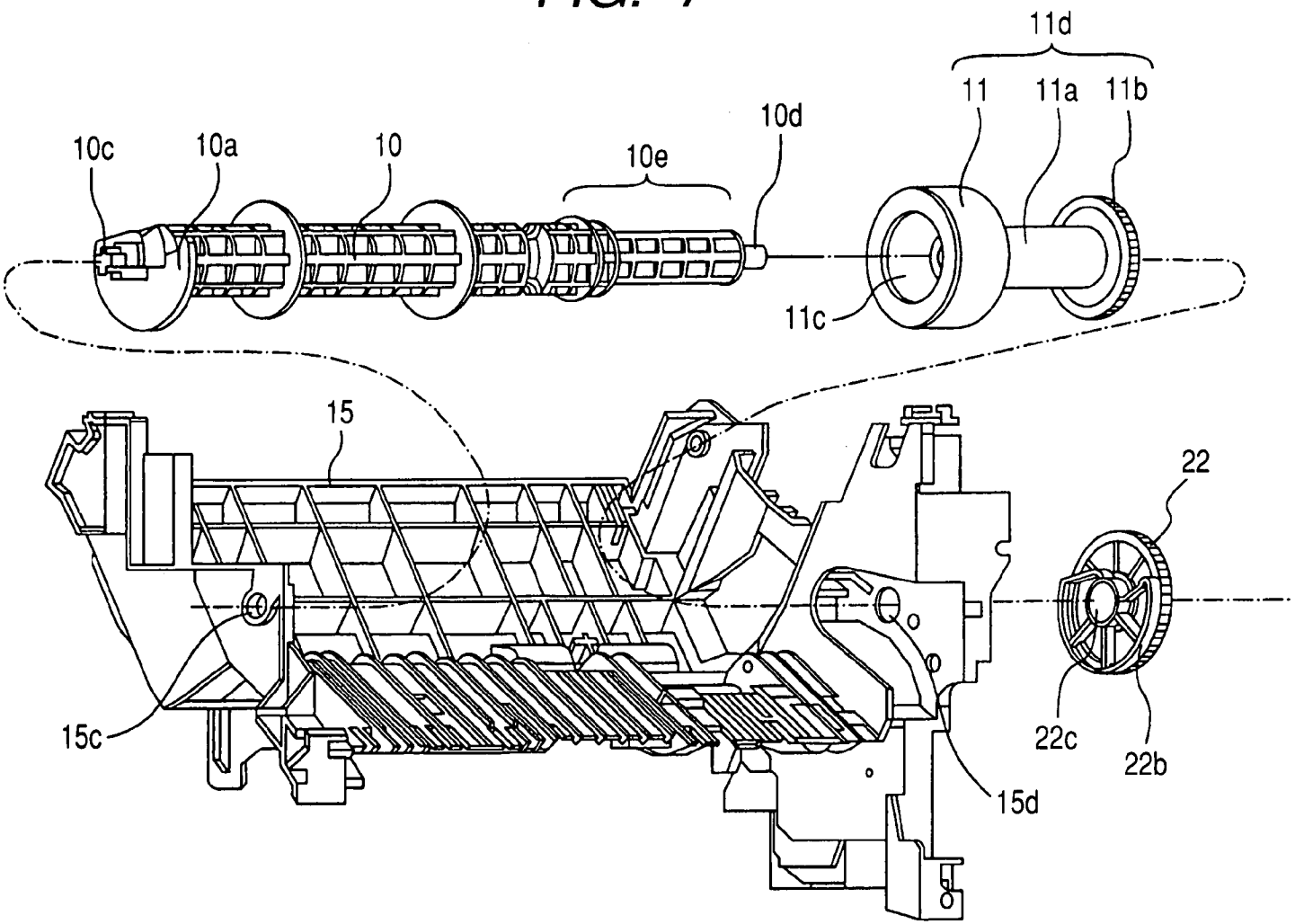
FIG. 7 is a partial perspective view illustrating constructions of a sheet feeding roller body and a sheet feeding shaft of the sheet feeding apparatus according to one embodiment of the present invention.

FIG. 6 is a partial perspective view illustrating a gear portion of an ASF control gear. FIG. 7 is a partial perspective view illustrating constructions of the sheet feeding roller and of the sheet feeding shaft.

The drive mechanism of the sheet feeding/separating portion includes a sun gear 20 receiving a driving force from the unillustrated ASF motor, a planetary gear 21, a gear portion 11*b* defined as a sheet feeding roller gear rotating integrally with the sheet feeding roller 11, a sheet feeding shaft gear 22 rotating integrally with the sheet feeding shaft 10, an ASF control gear 23 defined as a sheet feeding roller fore-gear that meshes with the gear portion 11*b* and thus transmits the driving force to the gear portion 11*b*, and an ASF gear 43 defined as a sheet feeding shaft fore-gear that meshes with the sheet feeding shaft gear 22 and thus transmits the driving force to the sheet feeding shaft gear 22. The ASF control gear 23 and the ASF gear 43 are constructed so that these gears 23 and 43 mesh with each other and integrally rotate about the same axis.

Further, the drive mechanism of the sheet feeding/separating portion has a separation roller press spring 25 for pressing the separation roller 12 towards the sheet feeding roller 11, and a separation roller holder 26 for rotatably supporting the separation roller 12.

The driving force transmitted from the ASF motor acts to rotate the sun gear 20 in an arrowhead direction F in FIG. 3. The driving force thereof is transmitted to the sheet feeding shaft gear 22 while being decelerated via the planetary gear 21 and the ASF gear 43, thereby rotating the sheet feeding shaft gear 22 in an arrowhead direction E in FIG. 3. Further, the driving force is transmitted to the ASF control gear 23 meshing and thus rotating with the ASF gear 43 together, however, the sheet feeding shaft gear 22 and the ASF gear 43 are connected at a gear ratio of 1:1 and therefore rotate invariably in a synchronized angular phase.

The ASF control gear 23 has such a gear structure that its gear portion is, as shown in FIG. 6, formed with a cog missed gear 23*b*. Therefore, when the cog missed gear 23*b* of the ASF control gear and the sheet feeding shaft gear 22 are positioned facing each other, the driving force is not transmitted. Further, the backface of the ASF control gear 23 is formed respectively with an unillustrated return lever cam groove and an unillustrated separation roller control cam groove in order to control movements of the return lever cam 13 and of the separation roller 12.

A cam follower portion of the unillustrated return lever control cam that engages with the return lever 13, follows up the return lever cam groove of the ASF control gear 23, whereby the return lever control cam is drive-controlled in synchronization with the sheet feeding shaft 10.

Moreover, as for a position of the separation controller 12, a separation roller control cam 27 which will be explained later on is driven along the separation roller control cam groove, and the separation roller 12 is thereby drive-controlled as below in synchronization with rotations of the sheet feeding shaft 10.

The separation roller 12 is rotatably held by the separation roller holder 26, and the separation roller holder 26 is also rotatably supported. A separation roller press spring 25 engaging with a hook portion 40*a* of the ASF bottom cover 40 acts on one end of the separation roller holder 26, thereby biasing the separation roller 12 toward the sheet feeding roller 11. The separation roller control cam 27 releases the separation roller holder 26 from being biased by the separation roller press spring 25 at a predetermined timing that will hereinafter be explained, thereby drive-controlling the separation roller so as to get apart from the sheet feeding roller 11.

The aforementioned separating mechanism of the pressure plate 16 is that the pressure plate cam 10*a* provided on a first end portion 10*c* of the sheet feeding shaft 10 and the pressure plate cam 22*b* provided coaxially with the sheet feeding shaft gear 22, simultaneously push the cams 16*a* and 16*b* provided on both sides of the pressure plate 16, whereby the pressure plate 16 is uniformly rotationally moved.

Next, structures of a sheet feeding roller body 11*d* and of the sheet feeding shaft 10 will be described with reference to FIG. 7.

The sheet feeding roller body 11*d* is constructed of a cylindrical sheet feeding roller support member 11*a* provided with the sheet feeding roller 11 and a gear 11*b* defined as a sheet feeding roller gear on both sides thereof, and is formed with a through-hole 11*c* penetrating the sheet feeding roller 11, the sheet feeding roller support member 11*a* and the gear 11*b*. The sheet feeding roller 11, the gear 11*b* and the sheet feeding roller support member 11*a* are integrally built up, whereby the sheet feeding roller 11 and the gear 11*b* rotate together.

The sheet feeding shaft 10 is provided with the pressure plate cam 10*a* on the first end portion 10*c* serving as a left-sided end portion in FIG. 7 and with the pressure plate cam 22*b* at a second end portion 10*d* serving as a right-sided end portion in FIG. 7, respectively. Namely, these pressure plate cams 10*a* and 22*b* are provided outside a sheet material conveying route. Further, the second end portion 10*d* of the sheet feeding shaft 10 is provided with a support portion 10*e* inserted through the through-hole 11*c* of the sheet feeding roller body 11*d* and thus rotatably supporting the sheet feeding roller 11.

Next, the way of attaching the sheet feeding roller body 11*d* and the sheet feeding shaft 10 to the ASF base 15, will be explained.

At first, the support portion 10*e* of the sheet feeding shaft 10 is inserted through the through-hole 11*c* of the sheet feeding roller body 11*d*, and the second end portion 10*d* is protruded from the side of the gear 11*b*. The support portion 10*e* is inserted with a gap through the through-hole 11*c*, and hence the sheet feeding roller body 11*d* comes to a state of being rotatably supported by the support portion 10*e*, i.e., a state of being so supported as to be rotatable about the sheet feeding shaft 10.

Subsequently, the first end portion 10*e* is inserted into a hole portion 15*c* of the ASF base 15, and similarly the second end portion 10*d* is also inserted into a hole portion 15*d* of the ASF base 15. The first end portion 10*c* and the second end portion 10*d* are thereby set in a state of being rotatably supported within the respective hole portions 15*c* and 15*d*. The second end portion 10*d* of the sheet feeding shaft 10, which protrudes from the hole portion 15*d*, receives insertion of an engagement hole 22*c* of the sheet feeding shaft gear 22, whereby the sheet feeding shaft 10 and the sheet feeding shaft gear 22 are integrally constructed and rotate together.

The sheet feeding shaft 10 attached to the ASF base 15 in the way described above receives the driving force via the sheet feeding shaft gear 22, and the sheet feeding roller body 11*d* is supported rotatably coaxially with the sheet feeding shaft 10 and thus receives the driving force via the gear 11*b* from the ASF control gear 23.

Next, a relationship between control members and the sheet feeding shaft 10 will be explained.

The sheet feeding apparatus according to the present embodiment includes the separation roller control cam 27, the return lever control cam 14 and the pressure plate cams 10*a*, 22*b* serving as the control members for feeding only one sheet material with one cyclic operation of the separation roller 12, the return lever 13 and the pressure plate 16 in combination.

Cam follower portions of the separation roller control cam 27 and of the return lever control cam 14 are so constructed as to follow up the separation roller control cam groove and the return lever cam groove that are formed in the undersurface of the ASF control gear 23. The ASF control gear 23 meshes with the ASF gear 43. The ASF gear 43 is set at a speed reduction ratio of 1:1 with respect to the sheet feeding shaft gear 22 fixed to and rotating together with the sheet feeding shaft 10. With this setting, the sheet feeding shaft 10 makes one rotation when each of the separation roller control cam 27 and the return lever control cam 14 makes one rotation for one cyclic operation for feeding only one sheet material.

The pressure plate cam 10*a* is provided on the sheet feeding shaft 10, and the pressure plate cam 22*b* is also provided coaxially with the sheet feeding shaft gear 22. Accordingly, when the sheet feeding shaft 10 makes one rotation, the pressure plate cams 10*a* and 22*b* make one rotations for one cyclic operation in order to feed only one sheet material.

Thus, the sheet feeding shaft 10 makes one rotation for one cyclic operation based on these cams, however, the sheet feeding roller 11 according to the present embodiment is capable of making a larger amount of rotation than one rotation in contrast with the sheet feeding shaft 10 making one rotation. Namely, according to the present embodiment, the number of gear teeth of the ASF control gear 23 is set to 43, and the number of teeth of the gear portion 11*b* of the sheet feeding roller support member 11*a* is set to 34. Hence, the sheet feeding roller 11 makes approximately 1.27 rotation for a period during which the ASF control gear 23 makes one rotation, i.e., the ASF control gear 23 and the sheet feeding roller 11 rotate at the fixed ratio. The sheet feeding roller 11 make a greater amount of rotation by 0.27 than one rotation of the sheet feeding shaft 10, and hence a conveyance length ranging from the sheet stacking portion to an ASF exit (a sheet lead-in roller on the side of the main body unit) can be elongated corresponding to this exceeded 0.27-rotation. Therefore, if the conveyance length is extended, this must be corresponded by increasing a diameter of the sheet feeding roller in the conventional construction where the sheet feeding roller makes one rotation as the sheet feeding shaft make one rotation, however, the construction according to the present embodiment has no necessity of increasing the diameter of the sheet feeding roller 11.

Moreover, as the construction is that the sheet feeding roller body 11*d* is rotatably supported by the sheet feeding shaft 10, the sheet feeding roller 11 and the sheet feeding shaft 10 are coaxially disposed and can be nevertheless rotated at the relatively different numbers of rotations (different rotational or angular speeds).

With the aforementioned contrivance such as the construction of increasing the diameter of the sheet feeding roller or causing the sheet feeding roller to make the larger amount of rotation than the sheet feeding shaft, the apparatus itself can be downsized to a greater degree than the construction where the sheet feeding roller is disposed on the axis of rotation that is different from the axis of rotation of the sheet feeding shaft.

It is to be noted that the present embodiment has exemplified the case in which the extended conveyance length is corresponded by causing the sheet feeding roller 11 to make the larger amount of rotation than one rotation for the period during which the sheet feeding shaft 10 makes one rotation, and the gear ratio of the ASF control gear 23 to the gear portion 11*b* is therefore set to 0.787 (=1/1.27). The present invention is not, however, limited to this ratio and may include setting the number of rotations of the sheet feeding roller 11 and the number of rotations of the sheet feeding shaft 10 at a predetermined ratio according to the purpose. In the case of utilizing the ASF as a unit for a different category of product, it is possible to correspond to an optimum conveyance length ranging from the sheet stacking portion of the ASF that differs according to every product to the sheet lead-in roller on the side of the main body by changing this gear ratio. For example, if the conveyance length is shorter than in the present embodiment, the gear ratio is set to 1 or larger, wherein the sheet feeding roller 11 makes a less amount of rotation than one rotation for a period during which the sheet feeding shaft 10 performs one rotation, thereby enabling an easy correspondence to the conveyance length.

Figure 8A:
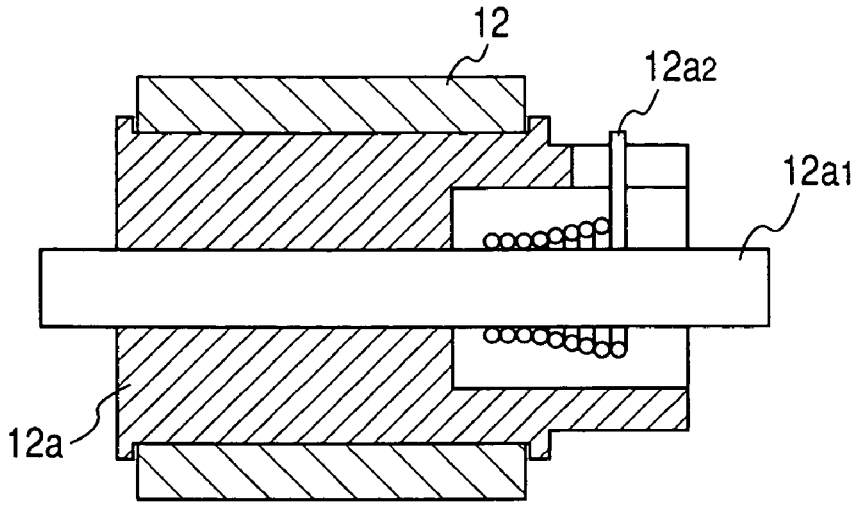
FIGS. 8A and 8B are schematic sectional views showing a construction of a torque limiter used for the sheet feeding apparatus according to one embodiment of the present invention.
Figure 8B:
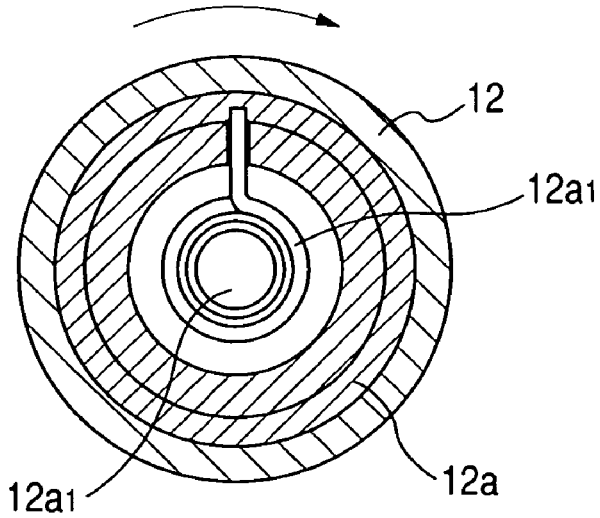

What has been explained so far is the construction of the drive mechanism of the sheet feeding/separating portion. Consecutively, the construction of the sheet feeding/separating portion will be described with reference to FIGS. 1 to 8A and 8B. FIGS. 8A and 8B are schematic sectional views showing a construction of a torque limiter used for the sheet feeding apparatus by way of one embodiment of the present invention.

Although the sheet feeding roller 11 conveys the uppermost sheet material in the stack of sheet materials stacked up, there are basically many cases in which the frictional force between the sheet feeding roller 11 and the uppermost sheet material is larger than the frictional force between the uppermost sheet material and a sheet material just under the uppermost sheet material, and consequently only the uppermost sheet material is conveyed almost invariably. The sheet feeding roller 11 might, however, draw out a plurality of sheet materials at one time in a case such as being affected by burrs produced at the end portions of the sheet material when cutting off the sheet material, causing the sheet materials to be stuck to each other due to static electricity and using the sheet material exhibiting an extremely large frictional coefficient of the surface. In such a case, according to the present embodiment, only the uppermost sheet material is separated by the following method.

The separation roller 12 is pressed by the sheet feeding roller 11 so that the sheet feeding roller 11 abuts on the sheet material more downstream in the conveying direction than at a point where the sheet feeding roller is brought into first contact with the sheet material. The separation roller 12 itself is simply rotatably held by the separation roller holder 26 but does not actively perform rotational driving.

A fixed spindle 12*a*1 of the separation roller 12 is, however, fixed to the separation roller holder 26, and a space between this fixed spindle 12*a*1 and the separation roller 12 accommodates a coil spring 12*a*2 composed of a metal or plastics. Initially the coil spring 12*a*2 fastens the fixed spindle 12*a*1, however, just when the separation roller 12 rotates through a predetermined angle with the result that the coil spring 12*a*2 gets slackened from the fixed spindle 12*a*1, the coil spring 12*a*2 and the fixed spindle 12*a*1 relatively slide thereon, thus attaining the construction of keeping predetermined torque required for rotating the separation roller 12 (see FIGS. 8A and 8B showing a sectional view representing the construction of the separation roller 12, and particularly showing the state where the coil spring 12*a*2 gets slackened from the fixed spindle 12*a*1).

Further, the separation roller 12 is composed of the rubber, elastomer, etc. exhibiting the high frictional coefficient such as EPDM (ethylene-propylene-diene-mixed-polymer) of which the hardness is on the order or 20° to 40° (A-scale) to have the frictional coefficient equal to that of the sheet feeding roller 11.

With this construction, when the sheet material is not inserted between the sheet feeding roller 11 and the separation roller 12, the separation roller 12 is rotated in a slave manner as the sheet feeding roller 11 rotates.

Further, when the single sheet material is inserted between the sheet feeding roller 11 and the separation roller 12, a conveying force based on the frictional force between the sheet feeding roller 11 and the sheet material is larger than a damping force applied onto the sheet material from the separation roller 12 driven with the predetermined torque by the action of the separation roller 12, and hence the sheet material is conveyed while the separation roller 12 is driven.

If two sheets of sheet materials are inserted between the sheet feeding roller 11 and the separation roller 12, however, the frictional force between the sheet feeding roller 11 and the sheet material existing on the side of the sheet feeding roller is larger than a frictional force between the sheet materials. Further, the frictional force between the sheet material existing on the side of the separation roller and the separation roller 12 is larger than the frictional force between the sheet materials, and consequently a slip occurs between the sheet materials. As a result, since the torque causing the separation roller 12 to be rotationally driven is less than the predetermined torque, only the sheet material existing on the side of the sheet feeding roller 11 is conveyed, whereas the sheet material existing on the side of the separation roller 12 stops and remains non-conveyed there as the separation roller 12 does not rotate.

What has been described so far is the outline of the separating portion employing the separation roller 12.

(Double-Feeding Preventive Portion)

As discussed above, even when the two sheet materials enter a nip between the sheet feeding roller 11 and the separation roller 12 abutting on this roller 11, these sheet material can be separated. If the two or more sheet materials enter, or if the two sheet materials enter and, after only the sheet material existing on the side of the sheet feeding roller has been conveyed, a next sheet material is to be fed consecutively as the sheet materials is left in the vicinity of the nip, there might occur double-feeding of the sheet materials, wherein the plurality of sheet materials are simultaneously conveyed. The double-feeding preventive portion is provided for preventing this double-feeding.

Figure 9:
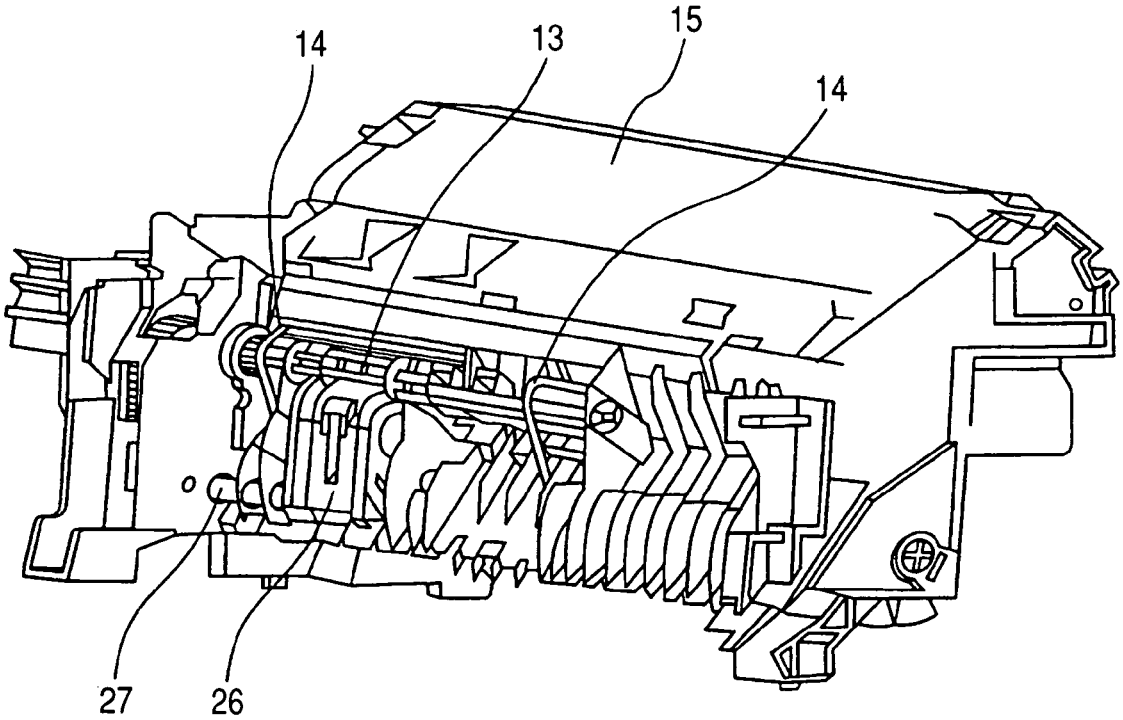
FIG. 9 is a schematic perspective view showing the way of attaching a return lever in the sheet feeding apparatus according to one embodiment of the present invention.
Figure 10:
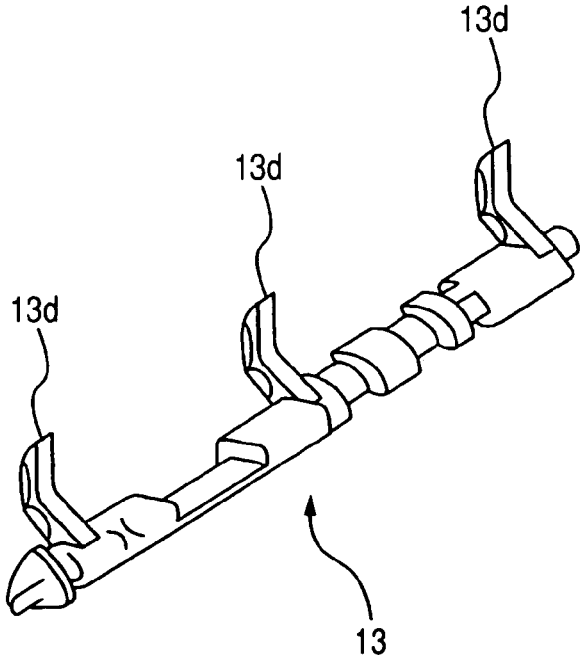
FIG. 10 is a schematic perspective view of the return lever used for the sheet feeding apparatus according to one embodiment of the present invention.

FIG. 9 shows a schematic perspective view with some portions simplified, illustrating how the return lever 13 in the sheet feeding apparatus according to the present embodiment is attached. FIG. 10 shows a schematic perspective view of the return lever 13 serving as the double-feeding preventive portion.

As shown in FIG. 10, the return lever 13 is provided with a plurality of lever portions 13*d* (three pieces of lever portions 13*d* are provided in the present embodiment). Further, as shown in FIG. 9, a return lever biasing spring 14 fitted to the ASF base 15 always biases the return lever 13 in a direction of the front end of the lever portion, i.e., in such a direction as to get vicinal to the sheet material. Moreover, with an unillustrated structure, the return lever 13 is so constructed as to be movable on the whole in the direction of the lever front end.

A structure of the rotational operation of the return lever 13 is that the return lever 13 rotates synchronizing with the rotational operation of the return lever control cam.

Figure 11A:
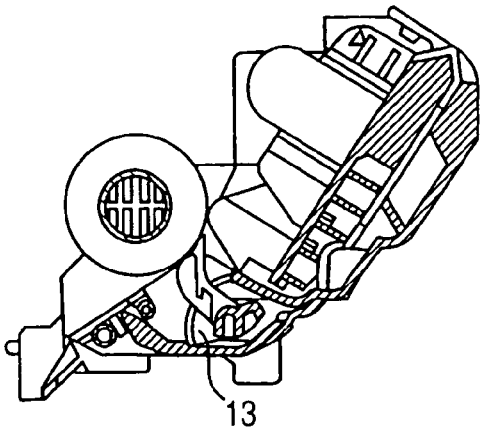
FIGS. 11A, 11B, 11C, and 11D are schematic perspective partial sectional views showing an operation of the return lever in the sheet feeding apparatus according to one embodiment of the present invention.
Figure 11B:
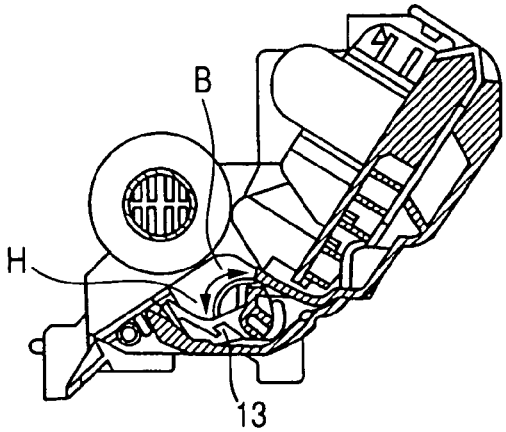

As the explanation of the construction of the drive mechanism of the sheet feeding/separating portion has been given, the return lever 13 operates synchronizing with the A-directional rotation (see FIG. 3) of the ASF control gear 23, however, the basic operation will be described as follows. FIGS. 11A and 11B are partial sectional views illustrating the operation of the return lever 13.

In the case of the present embodiment, basically, the return lever 13 can take three types of positions such as a first position, a second position and a third position.

FIG. 11A shows a state on standby for feeding. The lever portions 13*d* of the return lever 13 are made to advance into the sheet material conveying route, thereby preventing the leading end of the sheet material from entering a deep area of the sheet feeding apparatus carelessly when setting the sheet material. The first position is a position of the return lever 13 in this state.

FIG. 11B shows a state just subsequent to the state in FIG. 11A.

The ASF control gear 23 further rotates in the arrowhead direction A in FIG. 3, while the return lever control cam 14 and the return lever 13 rotate in an arrowhead direction H in FIG. 11B. This position indicates a position to which the lever portions 13*d* of the return lever 13 move farthest in the arrowhead direction H in FIG. 11B. The second position is a position of the return lever 13 in this state.

Figure 11C:
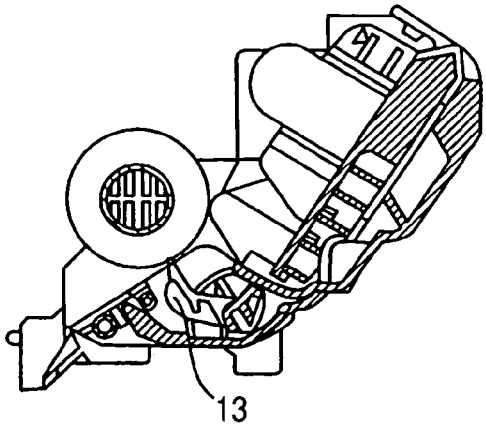

FIG. 11C shows a state where the return lever 13 starts returning in the direction in FIG. 11A in the middle of the feeding operation.

Figure 11D:
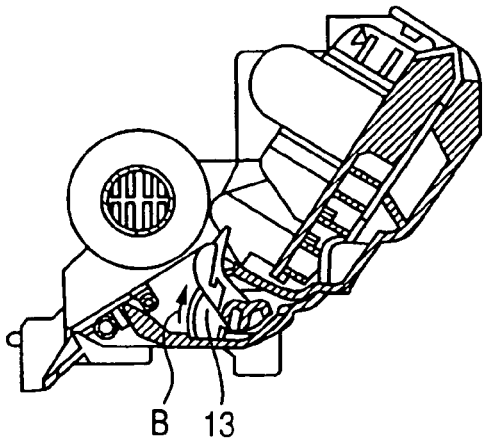

FIG. 11D shows a position of the return lever 13 after finishing the return operation of the sheet material. Performed is an operation of returning the leading end of the sheet material to a predetermined sheet material leading end fiducial portion 15*b*. This position of the lever portion 13*d* of the return lever 13 is the farthest-moved position in an arrowhead direction B in FIG. 11. When reaching this position, the leading end of the going-ahead sheet material is completely pushed back to the sheet material leading end fiducial portion 15*b*. The third position is a position of the return lever 13 in this state.

Then, next the ASF control gear 23 further rotates in the arrowhead direction A in FIG. 3, and the return lever 13 moves to the state on standby for feeding in FIG. 11A.

Next, an operation related state of the mechanism will be described with reference to a timing chart.

Figure 12:
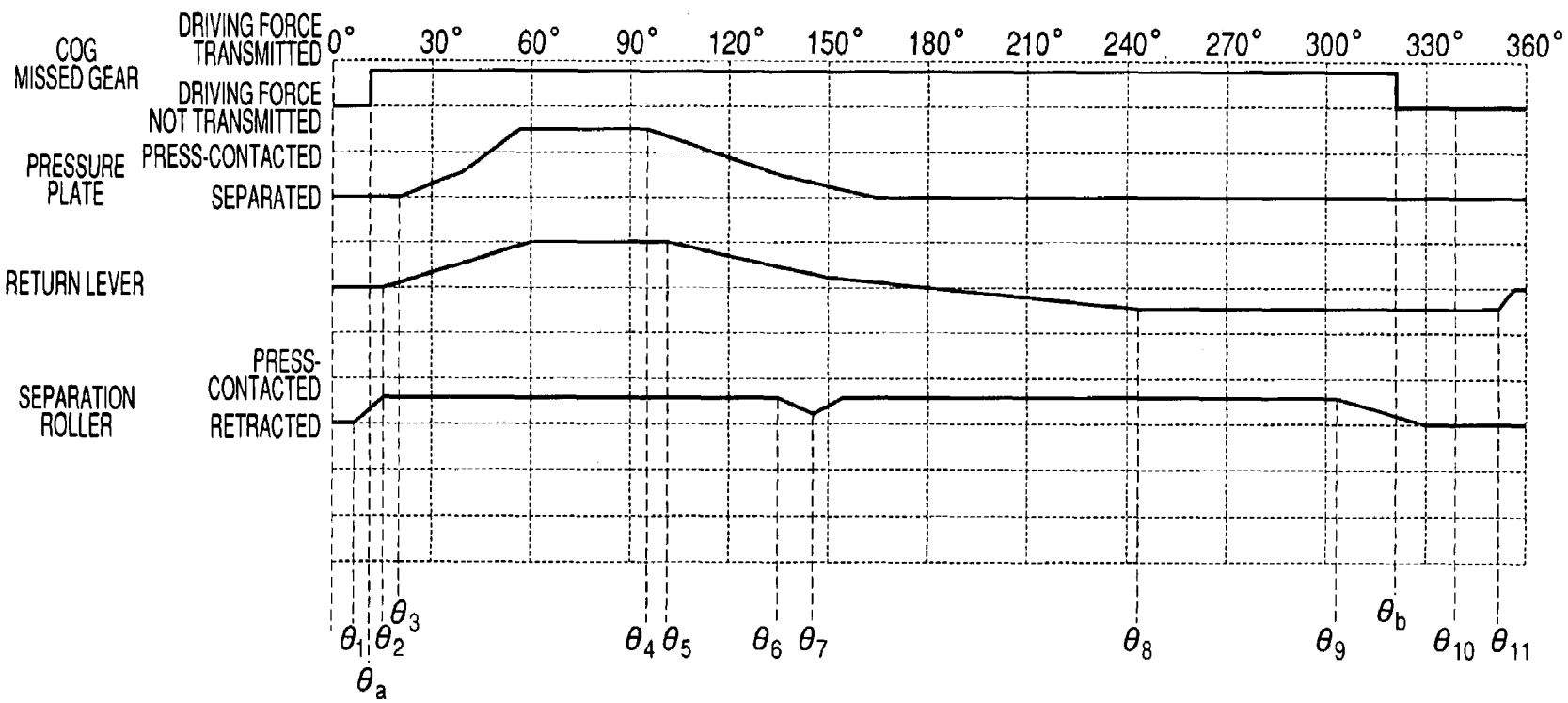
FIG. 12 is a timing chart showing an operation of the sheet feeding apparatus according to one embodiment of the present invention.

FIG. 12 is a timing chart showing the operation of the sheet feeding apparatus in the present embodiment. FIG. 12 shows a position of the pressure plate 16, a position of the return lever 13, a position of the separation roller 12 and an angle of the ASF control gear 23.

An angle 0° of the ASF control gear 23 in FIG. 12 represents the state in FIG. 11A. A series of operations start from the standby state in FIG. 11A.

In the position of the angle 0° in the timing chart in FIG. 12, the pressure plate 16 is held in a separated position, the lever portions 13*d* of the return lever 13 advance into the sheet material conveying route in the position in FIG. 11A, and the separation roller 12 is in a retracted position.

Next, when the ASF control gear 23 rotates through an angle θ1, at first the separation roller control cam 27 operates and starts shifting the position of the separation roller 12 to a press-contacted position from the retracted position.

Subsequently, when the ASF control gear 23 rotates through an angle θ2, the lever portions 13*d* of the return lever 13 start moving toward the position in FIG. 10B. From approximately this angle (θa), the cog missed portion 23*b* of the ASF control gear 23 begin to disappear, and the ASF control gear 23 starts meshing with the sheet feeding shaft gear 22. Then, there occurs a state in which the driving force of the ASF control gear is transmitted to the sheet feeding shaft gear.

Next, in the vicinity of the angle θ2, the separation roller 12 having moved in the press-contacted direction completes its movement, a cylindrical face 11*b* of the sheet feeding roller 11 comes into press-contact with the separation roller. At this time, the separation roller 12 is driven in the slave manner to the sheet feeding roller 11, and hence the coil spring 12*a*2 in the separation roller 12 is charged up to the predetermined torque.

At this moment, the return lever 13 starts retracting from the conveying route, however, even if the sheet material stacked up enters the conveying route, as the separation roller 12 has already been brought into press-contact with the sheet feeding roller 11, it does not happen that the sheet material falls in downstream of the nip portion between the sheet feeding roller 11 and the separation roller 12.

Next, from an angle θ3, the pressure plate 16 is released from its fixation and starts being press-contacted toward the sheet feeding roller 11, and the uppermost sheet material in the stacked sheet materials P is brought into the press-contact with the sheet feeding roller 11. Here at, even when the pressure plate 16 comes into the press-contact toward the sheet feeding roller 11, the return lever 13 has already been retracted from the conveying route, and therefore the sheet material is not damaged by the return lever 13. Upon being press-contacted, as described above, the sheet material starts being conveyed.

If the plurality of sheet materials have been conveyed as explained above, the sheet materials are conveyed toward the main body (in the arrowhead direction Y in FIG. 1) in a way that separates the sheet materials in the separating portion, and so on.

Next, in the vicinity of an angle θ4, the pressure plate 16 starts its separating operation. When the pressure plate 16 is separated, the chief press-contact of the sheet material with the sheet feeding roller 11 is released, so that the conveying force for the sheet material is decreased. The separation roller 12 and the sheet feeding roller 11 are still kept in the press-contact, however, the sheet material therefore continues to be conveyed.

Next, in the vicinity of an angle θ5, the return lever 13 starts rotating in the arrowhead direction B in FIG. 11B.

Subsequently, in the vicinity of an angle θ6, with the operation of the separation roller control cam 27, the separation roller 12 starts being released from the press-contact with the sheet feeding roller 11. When this press-contact is canceled, the force of bringing the sheet material into the press-contact with the sheet feeding roller 11 disappears, and therefore the sheet material holding force on the side of the sheet feeding apparatus vanishes. Immediately after this sheet material holding force has just vanished, the lever portions 13*d* of the return lever 13 begin to advance into the sheet material conveying route, and, if the leading end of the next sheet material stays in the vicinity of the nip between the sheet feeding roller 11 and the separation roller 12, the leading end of the sheet material is picked back by the front edge of the return lever 13. At this time, the separation roller 12 gets separated from the sheet feeding roller 11, as none of the conveying force for the sheet material is generated, the sheet material can be smoothly returned even in the case where the return lever 13 picks back the sheet material existing downstream of the nip portion between the sheet feeding roller 11 and the separation roller 12. Moreover, at this time, the pressure plate 16 has already moved in such a direction as to get separated from the sheet feeding roller 11, and hence the conveying force of the sheet feeding roller 11 that is based on the press-contact force of the pressure plate 16 has vanished. The sheet material can be therefore smoothly returned.

Next, when the ASF control gear 23 rotates through an angle θ7, the separation roller control cam 27 operates and again starts shifting the position of the separation roller 12 to the press-contacted position from the retracted position.

Subsequently, in the vicinity of an angle θ8, the lever portions 13*d* of the return lever 13 are completely returned to the position in FIG. 11D, and the leading ends of all the sheet materials excluding the sheet material in the midst of being fed are conveyed in the opposite direction up to the sheet material leading end fiducial portion 15*b*.

Next, in the vicinity of an angle θ9, with the operation of the separation roller control cam 27, the separation roller 12 again starts being released from the press-contact with the sheet feeding roller 11. When this press-contact is canceled, the force of bringing the sheet material into the press-contact with the sheet feeding roller 11 disappears, and therefore the sheet material holding force on the side of the sheet feeding apparatus vanishes.

Then, in a state where the ASF is halted at θ10, the sheet conveying control is completely transferred to the main body side. At this time, the angle has already exceeded θb, and the cog missed portion 23*b* of the ASF control gear 23 has reached the position facing the sheet feeding shaft gear 22. Then, there comes to a state where the driving force is not transmitted (FIG. 6). Therefore, the sheet feeding roller 11 is in the state of being capable of rotating without any restriction and does not apply a back tension to the sheet, wherein the sheet conveying control on the side of the main body is not affected.

Finally, a sensor or the like provided on the main body confirms that a trailing end of the sheet material has been discharged out of the automatic feeding apparatus, and, in the vicinity of the angle θ10, the lever portions 13*d* of the return lever 13 are returned to the position in FIG. 11A.

Through the processing described above, the sheet feeding shaft 10 makes one rotation, whereby one cyclic operations of the plurality of control members for feeding only one sheet material are finished. With these operations finished, according to the present embodiment, though not illustrated in FIG. 12, the sheet feeding roller 11 makes 1.27-rotation.

Note that the separating portion in the present embodiment involves using the friction separating system utilizing the torque limiter, however, the gist of the present invention is not confined to this torque limiter. The present invention can be, as a matter of course, applied to all types of separation systems such as a friction separating system utilizing a friction pad, an inclined face separation system, and so on.

As discussed above, according to each embodiment of the present invention, when the sheet feeding shaft makes one rotation for one cyclic operations of the plurality of control members, the sheet feeding roller can make the greater amount of rotation than one rotation. Hence, even in the case of the large conveying length required, there is no necessity of increasing the diameter of the sheet feeding roller. The product (apparatus) can be thereby downsized, and with this downsizing the costs can be restrained. Further, the present invention is also capable of causing the sheet feeding roller to make a less amount of rotation than one rotation with respect to one cyclic operations of the control members, and can be therefore diverted to a main body unit having a comparatively short conveying length. Accordingly, the costs do not increase as by changing the sheet feeding roller itself, and so forth.

This application claims priority from Japanese Patent Application No. 2003-306414 filed Aug. 29, 2003, which is hereby incorporated by reference herein.

What is claimed is:

1. A sheet feeding apparatus for feeding a sheet material by separating the sheet material from a plurality of stacked sheet materials, said apparatus comprising:

a pressure plate for stacking the sheet materials thereon;

a sheet feeding roller that feeds the sheet material stacked on said pressure plate;

a separation roller that abuts said sheet feeding roller to separate the sheet material;

a sheet feeding shaft that rotatably supports said sheet feeding roller;

a sheet feeding shaft gear that rotates integrally with said sheet feeding shaft, a cam for causing said pressure plate to move to a position abutting said sheet feeding roller and to a position separated from said sheet feeding roller, wherein the cam is arranged coaxially with said sheet feeding shaft that rotates integrally with the cam;

an ASF gear that meshes with said sheet feeding shaft gear, wherein the number of teeth of said ASF gear is equal to that of said sheet feeding shaft gear;

a sheet feeding roller gear, arranged coaxially with said sheet feeding shaft gear, that rotates integrally with said sheet feeding roller; and an ASF control gear, arranged coaxially with said ASF gear, that rotates integrally with said ASF gear and meshes with said sheet feeding roller gear, wherein the number of teeth of said ASF control gear is larger than that of said sheet feeding roller gear, wherein when the sheet feeding shaft makes one rotation, the cam makes one rotation for one cyclic operation in order to feed one sheet material, while the sheet feeding roller makes a larger amount of rotation than one rotation, wherein said sheet feeding apparatus further comprises a cylindrical sheet feeding roller support means integrally built up with said sheet feeding roller, a cylindrical sheet feeding roller support member being formed with a through-hole penetrated by the sheet feeding shaft, and the sheet feeding roller gear, and wherein the sheet feeding shaft is provided with a support portion inserted through the through-hole of the cylindrical sheet feeding roller support member.

2. A sheet feeding apparatus according to claim 1, wherein said cam is provided outside of a conveying route of the sheet materials stacked up on said pressure plate.

3. recording apparatus for recording record information on a fed sheet material by recording means, comprising:

said sheet feeding apparatus according to claim 1.

4. A recording apparatus according to claim 3, wherein said recording means is based on an inkjet system for recording on the sheet material by discharging liquid droplets via nozzles.

5. A sheet feeding apparatus according to claim 1, wherein said separation roller is arranged to be movable to the position abutting said sheet feeding roller and the position separated from said sheet feeding roller.

6. A sheet feeding apparatus according to claim 5, further comprising a return lever for returning a sheet material to said stacking portion, and said return lever is controlled by said ASF control gear.

* * * * *